US010008176B2

(12) United States Patent
Kim et al.

(10) Patent No.: US 10,008,176 B2
(45) Date of Patent: Jun. 26, 2018

(54) DISPLAY DRIVER INTEGRATED CIRCUIT (IC), METHOD OF OPERATING THE SAME, AND DEVICES INCLUDING THE SAME

(71) Applicant: Samsung Electronics Co., Ltd., Suwon-si, Gyeonggi-do (KR)

(72) Inventors: Yang Hyo Kim, Suwon-si (KR); Won Sik Kang, Seoul (KR); Jong Kon Bae, Seoul (KR); Jae Hyuck Woo, Osan-si (KR)

(73) Assignee: SAMSUNG ELECTRONICS CO., LTD., Samsung-ro, Yeongtong-gu, Suwon-si, Gyeonggi-do (KR)

( * ) Notice: Subject to any disclaimer, the term of this patent is extended or adjusted under 35 U.S.C. 154(b) by 218 days.

(21) Appl. No.: 14/534,606

(22) Filed: Nov. 6, 2014

(65) Prior Publication Data

US 2015/0154734 A1 Jun. 4, 2015

(30) Foreign Application Priority Data

Dec. 2, 2013 (KR) ..... 10-2013-0148663

(51) Int. Cl.
*G09G 5/00* (2006.01)
*G09G 3/20* (2006.01)

(52) U.S. Cl.
CPC ..... *G09G 5/006* (2013.01); *G09G 3/2092* (2013.01); *G09G 2330/021* (2013.01); *G09G 2340/00* (2013.01); *G09G 2360/08* (2013.01); *G09G 2360/12* (2013.01); *G09G 2360/18* (2013.01); *G09G 2370/08* (2013.01)

(58) Field of Classification Search
CPC ..... G09G 3/2092; G09G 5/006; G09G 2330/021; G09G 2340/00; G09G 2360/08; G09G 2360/12; G09G 2360/18; G09G 2370/08
USPC ..... 345/204, 545
See application file for complete search history.

(56) References Cited

U.S. PATENT DOCUMENTS

| | | | | |
|---|---|---|---|---|
| 8,069,316 | B2 | 11/2011 | Cho | |
| 8,120,599 | B2 | 2/2012 | Kang et al. | |
| 8,531,618 | B2 * | 9/2013 | Koyama | G02F 1/1368 345/87 |
| 2003/0210247 | A1 | 11/2003 | Cui et al. | |
| 2009/0002292 | A1 * | 1/2009 | Koo | G09G 3/3611 345/87 |
| 2011/0080419 | A1 * | 4/2011 | Croxford | G09G 5/393 345/531 |

(Continued)

FOREIGN PATENT DOCUMENTS

| | | |
|---|---|---|
| KR | 1020060004857 | 1/2006 |
| KR | 10-0840379 | 6/2008 |

(Continued)

*Primary Examiner* — Jacinta M Crawford
(74) *Attorney, Agent, or Firm* — Muir Patent Law, PLLC

(57) ABSTRACT

A display driver integrated circuit (IC) (DDI) includes a graphic memory that receives and stores line data including a plurality of pixel data blocks, an indicator generating circuit that compares the pixel data blocks of the line data received by the graphic memory with each other and generates an indicator signal corresponding to results of the comparison, and a read controller that performs a read operation with respect to the whole or a part of the line data from the graphic memory, based on a read command for the line data and the indicator signal.

16 Claims, 20 Drawing Sheets

(56) References Cited

U.S. PATENT DOCUMENTS

| | | | | |
|---|---|---|---|---|
| 2011/0157254 | A1* | 6/2011 | Yamazaki | G02F 1/13624 345/690 |
| 2013/0201124 | A1* | 8/2013 | Choi | G09G 5/363 345/173 |
| 2013/0235014 | A1* | 9/2013 | Lee | G06F 1/32 345/211 |
| 2013/0249779 | A1* | 9/2013 | Harada | G09G 3/3611 345/88 |
| 2014/0104327 | A1* | 4/2014 | Kim | G09G 5/02 345/691 |

FOREIGN PATENT DOCUMENTS

| | | |
|---|---|---|
| KR | 1020080071014 | 8/2008 |
| KR | 1020080084152 | 9/2008 |
| KR | 1020080086060 | 9/2008 |
| KR | 1020080111622 | 12/2008 |

* cited by examiner

FIG. 8

| LDATA | IND |
| --- | --- |
| LDATA1 | 1 |
| LDATA2 | 0 |
| ⋮ | ⋮ |

FIG. 12

| LDATA' | IND |
| --- | --- |
| LDATA3 | 1 |
| LDATA4 | 0 |
| ⋮ | ⋮ |

LDATA
LDATA'
F0
F0
A0
C1
C1
C1

DISPLAY DRIVER INTEGRATED CIRCUIT (IC), METHOD OF OPERATING THE SAME, AND DEVICES INCLUDING THE SAME

CROSS-REFERENCE TO RELATED APPLICATIONS

This application claims priority under 35 U.S.C. § 119(a) from Korean Patent Application No. 10-2013-0148663 filed on Dec. 2, 2013, the disclosure of which is hereby incorporated by reference in its entirety.

BACKGROUND OF THE INVENTION

1. Field of the Invention

Example embodiments relate to a display driver integrated circuit (IC) (DDI), and more particularly, to a DDI capable of performing a read operation with respect to a part of line data when pixel data blocks included in the line data are duplicated, a method of operating the DDI, and apparatuses including the DDI.

2. Description of the Related Art

DDIs are ICs for driving a display module that is implemented by using a liquid crystal display (LCD), a light emitting diode (LED) display, an organic LED (OLED) display, or the like.

As a super-high resolution display module has recently been mounted in a smartphone or a tablet personal computer (PC), there is a demand for a DDI having low power consumption and still having high performance.

SUMMARY OF THE INVENTION

The inventive concept provides a display driver integrated circuit (DDI) capable of performing a read operation with respect to a part of line data when pixel data blocks included in the line data are duplicated, a method of operating the DDI, and devices including the DDI.

Additional features and utilities of the present general inventive concept will be set forth in part in the description which follows and, in part, will be obvious from the description, or may be learned by practice of the general inventive concept.

Exemplary embodiments of the present inventive concept provide a DDI comprising a graphic memory that receives and stores line data including a plurality of pixel data blocks; an indicator generating circuit that compares the plurality of pixel data blocks of the line data received by the graphic memory with each other, and generates an indicator signal corresponding to results of the comparison; and a read controller that performs a read operation with respect to a whole or a part of the line data from the graphic memory, based on a read command for the line data and the indicator signal.

The indicator generating circuit may compare a reference pixel data block from among the plurality of pixel data blocks with each of remaining pixel data blocks from among the plurality of pixel data blocks. The reference pixel data block may be a first pixel data block from among the plurality of pixel data blocks.

The indicator generating circuit may include: a buffer circuit that receives and stores the reference pixel data block; and a comparison circuit that compares the reference pixel data block with each of the remaining pixel data blocks and generates the indicator signal corresponding to results of the comparison.

When each of the remaining pixel data blocks is the same as the reference pixel data block, the comparison circuit may generate an indicator signal of a first level. When at least one of the remaining pixel data blocks is not the same as the reference pixel data block, the comparison circuit may generate an indicator signal of a second level. The reference pixel data block may include a plurality of sub-pixel data blocks.

The comparison circuit may alternately compare the plurality of sub-pixel data blocks included in the reference pixel data block with each of the remaining pixel data blocks.

The indicator generating circuit may include: a buffer circuit that receives and buffers the line data; a comparison circuit that compares the line data with the buffered line data in units of pixel data blocks and outputs comparison signals corresponding to results of the comparisons; and a counter circuit that counts the comparison signals compares a counted value corresponding to a result of the counting with a reference value, and generates an indicator signal according to a result of the comparison.

The indicator may include a start address where repetition of pixel data blocks starts and data associated with the number of repeated pixel data blocks. The DDI may further include an image processing unit that processes the whole or part of the line data read by the read controller. The image processing unit may include a gating circuit to deactivate a part of the image processing unit, based on the indicator.

The DDI may further include a source shift register controller that controls whether a data shifting operation of a data shift register is performed, based on the indicator. When each of the remaining pixel data blocks is the same as the reference pixel data block, the source shift register controller may control the data shift register not to perform the data shifting operation. When at least one of the remaining pixel data blocks is different from the reference pixel data block, the source shift register controller may control the data shift register to perform the data shifting operation.

The comparison circuit may compare the plurality of pixel data blocks with each other, while the line data is being transmitted to and stored in the graphic memory.

Exemplary embodiments of the present inventive concept also provide a display device comprising a DDI; and a display panel that is driven by the DDI. The DDI includes a graphic memory that receives and stores line data including a plurality of pixel data blocks; an indicator generating circuit that compares the plurality of pixel data blocks of the line data received by the graphic memory with each other, and generates an indicator signal corresponding to results of the comparison; and a read controller that performs a read operation with respect to a whole or a part of the line data from the graphic memory, based on a read command for the line data and the indicator signal.

The indicator generating circuit may compare the reference pixel data block from among the plurality of pixel data blocks with each of the remaining pixel data blocks from among the plurality of pixel data blocks. The indicator generating circuit may include a buffer circuit that receives and buffers the reference pixel data block; and a comparison circuit that compares the stored reference pixel data block with each of the remaining pixel data blocks and generates the indicator signal corresponding to results of the comparison.

The indicator generating circuit may include: a buffer circuit that receives and buffers the line data; a comparison circuit that compares the line data with the buffered line data in units of pixel data blocks and outputs comparison signals corresponding to results of the comparisons; and a counter circuit that counts the comparison signals, compares a counted value corresponding to a result of the counting with a reference value, and generates an indicator signal according to a result of the comparison.

Exemplary embodiments of the present inventive concept also provide a display system including: a DDI; an application processor (AP) that outputs line data including a plurality of pixel data blocks to the DDI; and a display panel that is driven by the DDI. The DDI includes: a graphic memory that receives and stores the line data; an indicator generating circuit that compares the plurality of the pixel data blocks received by the graphic memory with each other and generates an indicator signal corresponding to results of the comparison; and a read controller that performs a read operation with respect to a whole or a part of the line data from the graphic memory, based on a read command for the line data and the indicator signal.

The indicator generating circuit may compare a reference pixel data block from among the plurality pixel data blocks with each of the remaining pixel data blocks from among the plurality pixel data blocks.

The indicator generating circuit may include: a buffer circuit that receives and stores the reference pixel data block; and a comparison circuit that compares the stored reference pixel data block with each of the remaining pixel data blocks and generates the indicator signal corresponding to results of the comparison.

The indicator generating circuit may include: a buffer circuit that receives and buffers the line data; a comparison circuit that compares the line data with the buffered line data in units of pixel data blocks and outputs comparison signals corresponding to results of the comparisons; and a counter circuit that counts the comparison signals, compares a counted value corresponding to a result of the counting with a reference value, and generates an indicator signal according to a result of the comparison.

Exemplary embodiments of the present inventive concept also provide a method of operating a DDI, the method including: comparing a plurality of pixel data blocks included in line data transmitted to a graphic memory with each other and generating an indicator signal corresponding to results of the comparison; and performing a read operation with respect to a whole or a part of the line data from the graphic memory, based on a read command for the line data and the indicator signal.

The method may further include gating input of the read whole or part of the line data to the image processing unit of the DDI, based on the indicator signal. The method may further include selecting output of the whole or part of the line data processed by the image processing unit, based on the indicator signal.

The method may further include selecting a clock signal provided to a data shift register of the DDI, based on the indicator signal.

Exemplary embodiments of the present inventive concept also provide a method of operating a display driver integrated circuit (DDI), the method comprising: analyzing a pattern of line data received through an interface; generating an indicator signal based on the results of the analysis; and performing a read operation with respect to a whole or a part of the line data based on a read command for the line data and the indicator signal.

In an exemplary embodiment, the analyzing a pattern of the line data comprises analyzing a pattern in which plurality of pixel data blocks included in the line data have identically or repeatedly.

In an exemplary embodiment, the analyzing a pattern further comprises comparing a reference pixel data block with each of remaining pixel data blocks of the plurality of pixel data blocks.

In an exemplary embodiment, when the reference pixel data block is the same as each of the remaining pixel data blocks, the indicator signal is output as a first level indicator signal, and when at least one of the remaining pixel data blocks is not the same as the reference pixel data block, the indicator signal is output as a second level indicator signal.

In an exemplary embodiment, the read operation is performed with respect to a graphic memory in which the pattern of line data is stored after being received through the interface.

BRIEF DESCRIPTION OF THE DRAWINGS

These and/or other features and utilities of the present general inventive concept will become apparent and more readily appreciated from the following description of the embodiments, taken in conjunction with the accompanying drawings of which:

FIG. 8 is a diagram of an indicator corresponding to the line data illustrated in each of FIGS. 6 and 7;

FIG. 12 is a diagram of an indicator corresponding to the line data illustrated in each of FIGS. 10 and 11;

DETAILED DESCRIPTION OF THE PREFERRED EMBODIMENTS

Figure 1:
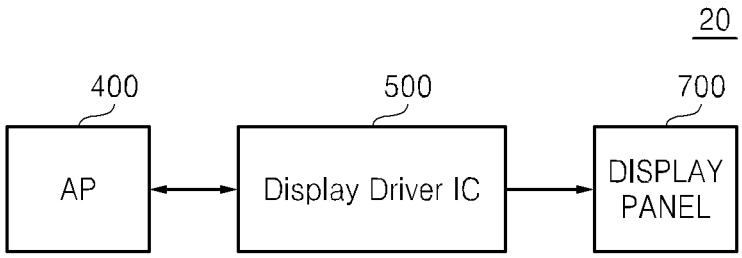
FIG. 1 is a block diagram of a display system according to an embodiment of the present inventive concept.

The present inventive concepts will now be described more fully hereinafter with reference to the accompanying drawings, in which embodiments of the inventive concept are shown. This present inventive concept may, however, be embodied in many different forms and should not be construed as limited to the embodiments set forth herein. Rather, these embodiments are provided so that this disclosure will be thorough and complete, and will fully convey the scope of the invention to those skilled in the art. In the drawings, the size and relative sizes of layers and regions may be exaggerated for clarity. Like numbers refer to like elements throughout.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. As used herein, the term "and/or" includes any and all combinations of one or more of the associated listed items and may be abbreviated as "/".

It will be understood that, although the terms first, second, etc. may be used herein to describe various elements, these elements should not be limited by these terms. These terms are only used to distinguish one element from another. For example, a first signal could be termed a second signal, and, similarly, a second signal could be termed a first signal without departing from the teachings of the disclosure.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and/or the present application, and will not be interpreted in an idealized or overly formal sense unless expressly so defined herein FIG. 1 is a block diagram of a display system 20 according to an embodiment of the present inventive concept. Referring to FIG. 1, the display system 20 may include an application processor (AP) 400, a display driver integrated circuit (IC) (DDI) 500, and a display panel 700.

According to exemplary embodiments, the display system 20 may be implemented by using a portable electronic device. The portable electronic device may be a mobile phone, a smartphone, a tablet personal computer (PC), a personal digital assistant (PDA), an enterprise digital assistant (EDA), a digital still camera, a digital video camera, a portable multimedia player (PMP), a personal navigation device or a portable navigation device (PND), a handheld game console, a mobile internet device (MID), an internet tablet, an e-book, or the like.

According to another exemplary embodiment, the DDI 500 and the display panel 700 may be implemented by using a separate display device (or a display module) except for the AP 400.

The AP 400 may control an overall operation of the display system 20. According to exemplary embodiments, the AP 400 may be implemented by using an IC, a system on chip (SoC), or a mobile AP. The AP 400 may transmit display data (for example, image data, moving image data, or still image data) that is desired to be displayed, to the DDI 500. According to an exemplary embodiment, the display data may be separated in units of line data corresponding to horizontal lines of the display panel 700.

The DDI 500 may process the display data received from the AP 400 and may transmit the processed display data to the display panel 700.

The display panel 700 may display the display data processed by the DDI 500. According to exemplary embodiments, the display panel 700 may be implemented by using a thin film transistor-liquid crystal display (TFT-LCD) panel, a light emitting diode (LED) display panel, an organic LED (OLED) display panel, an active matrix OLED (AMOLED) display panel, a flexible display panel, or the like.

Figure 2:
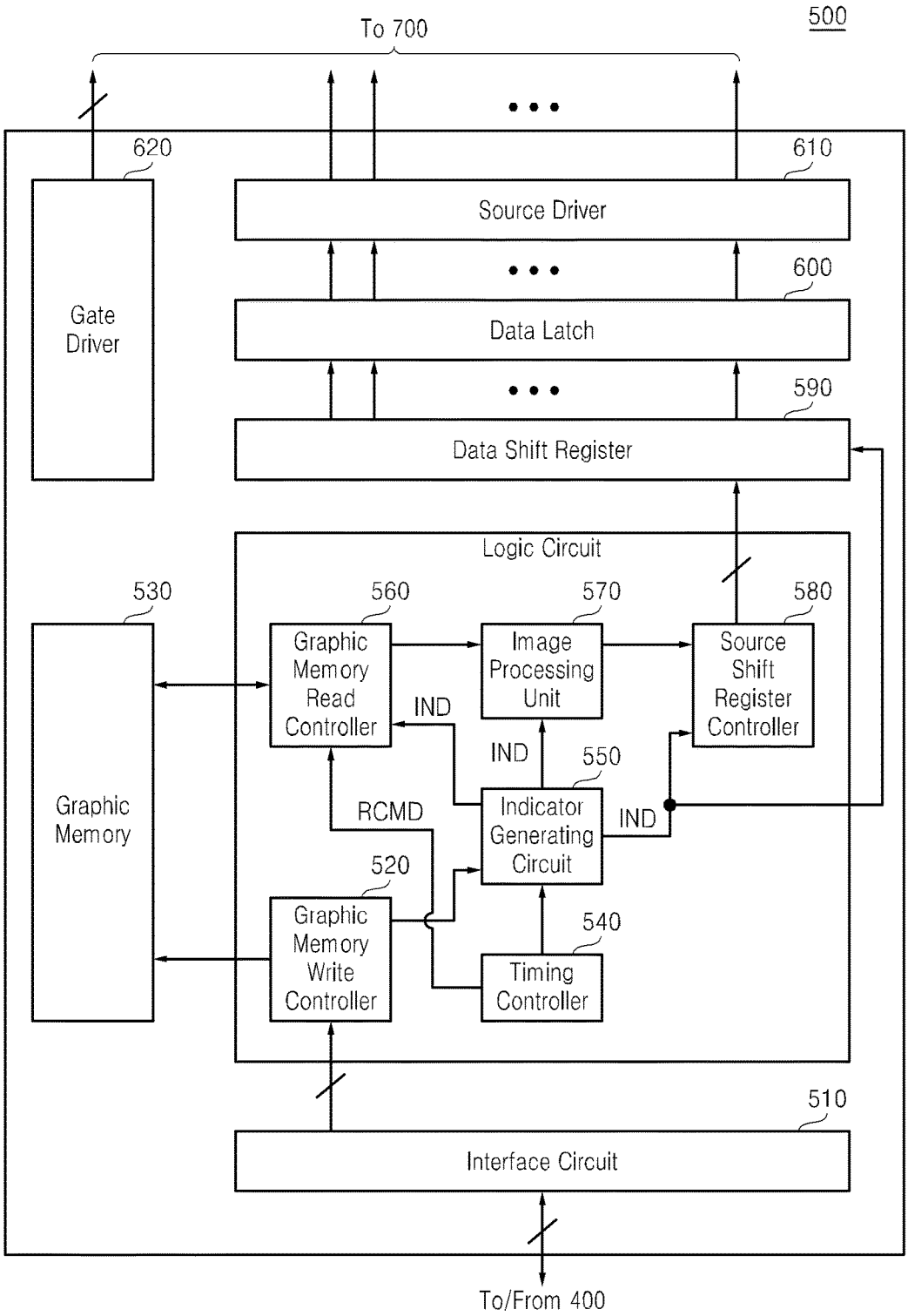
FIG. 2 is a block diagram of a display driver integrated circuit (IC)(DDI) illustrated in FIG. 2, according to an embodiment of the present inventive concept.

FIG. 2 is a block diagram of the DDI 500 illustrated in FIG. 1, according to an exemplary embodiment of the inventive concept. Referring to FIGS. 1 and 2, the DDI 500 may include an interface circuit 510, a graphic memory write controller 520, a graphic memory 530, a timing controller 540, an indicator generating circuit 550, a graphic memory read controller 560, an image processing unit 570, a source shift register controller 580, a data shift register 590, a data latch 600, a source driver 610, and a gate driver 620.

The interface circuit 510 may interface signals and/or data that are exchanged between the AP 400 and the DDI 500. The interface circuit 510 may receive line data from the AP 400 and may transmit the line data to the graphic memory write controller 520.

According to an exemplary embodiment, the interface circuit 510 may be an interface suitable for serial interfacing, such as a Mobile Industry Processor Interface (MIPI®), a Mobile Display Digital Interface (MDDI), a Display Port (DP), an Embedded Display Port (eDP), or the like.

The graphic memory write controller 520 may receive the line data from the interface circuit 510 and may control an operation of writing the received line data to the graphic memory 530. The graphic memory write controller 520 may transmit the received line data to the indicator generating circuit 550.

The graphic memory 530 may store the line data received from the graphic memory write controller 520, according to the control of the graphic memory write controller 520. The graphic memory 530 may operate as a buffer memory within the DDI 500. According to an exemplary embodiment, the graphic memory 530 may be implemented by using a graphic random access memory (GRAM).

The timing controller 540 may provide a synchronizing signal and/or a clock signal to each component (for example, the indicator generating circuit 550 or the graphic memory read controller 560) of the DDI 500. The timing controller 540 may also transmit a read command RCMD to control a read operation of the graphic memory 530 to the graphic memory read controller 560.

The indicator generating circuit 550 may analyze a pattern of the line data received from the graphic memory write controller 520, and may generate an indicator signal IND based on a result of the analysis. The indicator generating circuit 550 may transmit the indicator signal IND to each of the graphic memory read controller 560, the image processing unit 570, the source shift register controller 580, and the data shift register 590.

The indicator generating circuit 550 will be described in detail with reference to FIGS. 3 through 14.

The graphic memory read controller 560 may perform a read operation with respect to the line data stored in the graphic memory 530. According to an exemplary embodiment, the graphic memory read controller 560 may perform a read operation with respect to the whole or a part of the line data stored in the graphic memory 530, based on the read command RCMD for the line data and the indicator signal IND.

The graphic memory read controller 560 may transmit the whole or a part of the line data read from the graphic memory 530 to the image processing unit 570.

For convenience of explanation, the graphic memory write controller 520 and the graphic memory read controller 560 are separated from each other in FIG. 2, but they may be integrally formed into a single graphic memory controller.

The image processing unit 570 may improve an image quality by processing the whole or a part of the line data received from the graphic memory read controller 560.

The image processing unit 570 may deactivate a portion (or a part) of the image processing unit 570 based on the indicator signal IND received from the indicator generating circuit 550. This operation will be described in detail with reference to FIGS. 15 and 16.

The source shift register controller 580 may control an operation of the data shift register 590. The source shift register controller 580 may control a data shifting operation of the data shift register 590, based on the indicator signal IND received from the indicator generating circuit 550. This operation will be described in detail with reference to FIG. 17.

The data shift register 590 may shift line data received from the source shift register controller 580, according to the control of the source shift register controller 580. The data shift register 590 may sequentially transmit the shifted line data to the data latch 600.

The data shift register 590 may perform different operations according to levels of the indicator signal IND received from the indicator generating circuit 550. These operations will be described in detail with reference to FIG. 17.

The data latch 600 may store the shifted line data sequentially received from the data shift register 590 and may transmit the stored line data to the source driver 610 in units of horizontal lines of the display panel 700.

The source driver 610 may transmit the line data received from the data latch 600 to the display panel 700.

The gate driver 620 may drive gate lines of the display panel 700. In other words, as operations of pixels implemented on the display panel 700 are controlled by the source driver 610 and the gate driver 620, display data (or an image corresponding to the display data) received from the AP 400 may be displayed on the display panel 700.

Figure 3:
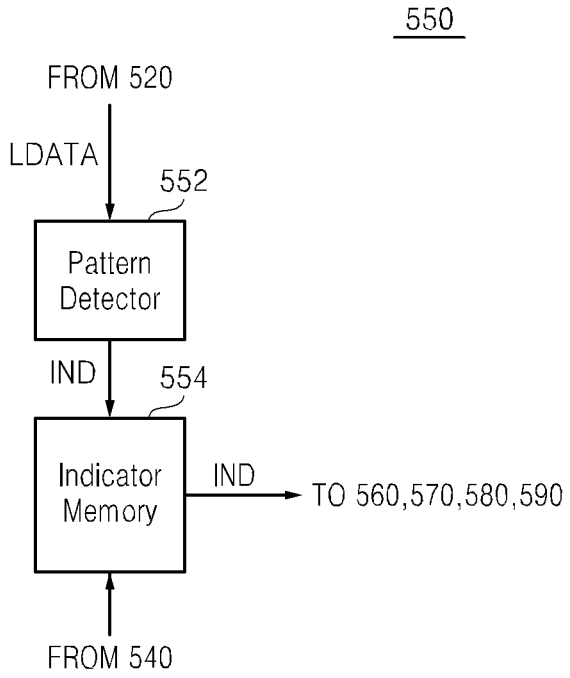
FIG. 3 is a block diagram of an indicator generating circuit illustrated in FIG. 2.

FIG. 3 is a block diagram of the indicator generating circuit 550 illustrated in FIG. 2. Referring to FIGS. 2 and 3, the indicator generating circuit 550 may include a pattern detector 552 and an indicator memory 554.

The pattern detector 552 may receive line data LDATA from the graphic memory write controller 520, and may analyze a pattern of the received line data LDATA.

According to an embodiment, the pattern detector 552 may detect a pattern that a plurality of pixel data blocks included in the line data LDATA have identically. According to another embodiment, the pattern detector 552 may detect a pattern that the pixel data blocks included in the line data LDATA have repeatedly.

A detailed structure and operation of the pattern detector 552 will be described in detail with reference to FIGS. 5 and 13. The pattern detector 552 may detect the pattern of the line data LDATA and may generate an indicator signal IND that indicates the detected pattern. The generated indicator signal IND may be transmitted to the indicator memory 554.

The indictor memory 554 may store the indicator signal IND received from the pattern detector 552. The indicator memory 554 may transmit the stored indicator signal IND to each of the graphic memory read controller 560, the image processing unit 570, a source shift register controller 580, and the data shift register 590, according to the control of the timing controller 540. According to an embodiment, the indicator memory 554 may output the indicator signal IND before a read operation of the graphic memory read controller 560 is performed, according to the control of the timing controller 540.

Figure 4:
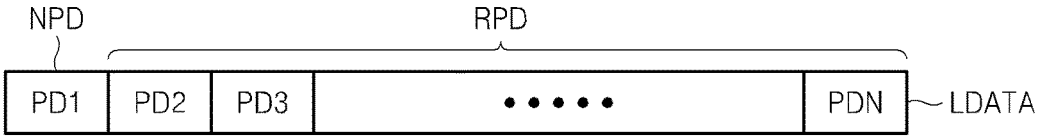
FIG. 4 is a diagram of a reference pixel data block and the rest of the pixel data blocks included in line data, according to an embodiment of the present inventive concept.

FIG. 4 illustrates a reference pixel data block NPD and remaining pixel data blocks RPD included in the line data LDATA, according to an embodiment of the inventive concept. Referring to FIG. 4, the line data LDATA may include a plurality of pixel data blocks PD1 through PDN (where N is a natural number).

Each of the pixel data blocks PD1 through PDN may denote data corresponding to a color displayed by a unit pixel of the display panel 700 of FIG. 1. According to an embodiment, the unit pixel may be a combination of pixels displaying different colors (for example, a red pixel, a green pixel, and a blue pixel).

According to an exemplary embodiment, a first pixel data block PD1 from among the pixel data blocks PD1 through PDN may be the reference pixel data block NPD, which serves as a basis for comparison. In this case, the remaining pixel data blocks RPD may denote the pixel data blocks PD2 through PDN of the line data LDATA except for the reference pixel data block NPD.

The remaining pixel data blocks RPD from among the pixel data blocks PD1 through PDN may be compared with the reference pixel data block NPD.

Figure 5:
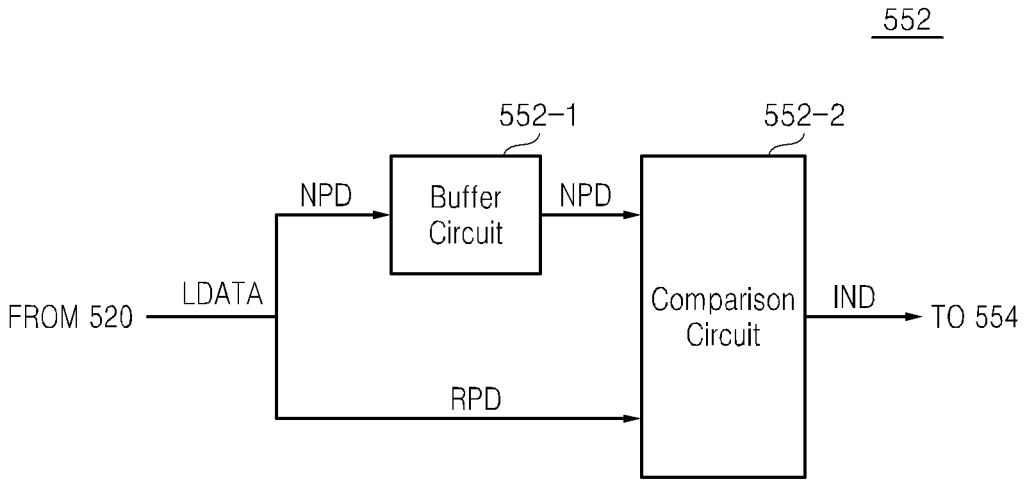
FIG. 5 is a block diagram of a pattern detector illustrated in FIG. 3.

FIG. 5 is a block diagram of the pattern detector 552 illustrated in FIG. 3, according to an exemplary embodiment of the inventive concept. Referring to FIGS. 3 through 5, the pattern detector 552 may include a buffer circuit 552-1 and a comparison circuit 552-2.

The buffer circuit 552-1 may receive and store the reference pixel data block NPD from among the pixel data blocks PD1 through PDN included in the line data LDATA received from the graphic memory read controller 520. The remaining pixel data blocks RPD from among the pixel data blocks PD1 through PDN may be directly transmitted to the comparison circuit 552-2 without passing through the buffer circuit 552-1.

The buffer circuit 552-1 may transmit the stored reference pixel data block NPD to the comparison circuit 552-2. The comparison circuit 552-2 may compare the reference pixel data block NPD received from the buffer circuit 552-1 with each of the remaining pixel data blocks RPD. The comparison circuit 552-2 may transmit indicator signals IND corresponding to results of the comparisons to the indicator memory 554.

According to an exemplary embodiment, when the reference pixel data block NPD is the same as each of the remaining pixel data blocks RPD, the comparison circuit 552-2 may output an indicator signal IND of a first level. However, when at least one of the remaining pixel data blocks RPD is not the same as the reference pixel data block NPD, the comparison circuit 552-2 may output an indicator signal IND of a second level.

Figure 6:
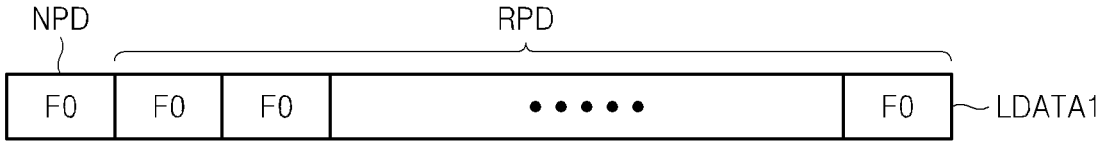
FIG. 6 is a diagram of the line data illustrated in FIG. 4, according to an embodiment of the present inventive concept.
Figure 7:
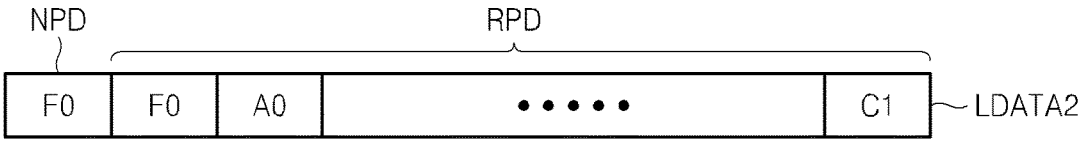
FIG. 7 is a diagram of the line data illustrated in FIG. 4, according to another embodiment of the present inventive concept.

FIG. 6 is a diagram of first line data LDATA1, which is an embodiment of the line data LDATA illustrated in FIG. 4. FIG. 7 is a diagram of second line data LDATA2, which is another embodiment of the line data LDATA illustrated in FIG. 4. FIG. 8 is a diagram of indicator signals IND corresponding to the first and second line data LDATA1 and LDATA2 respectively illustrated in FIGS. 6 and 7.

Referring to FIGS. 5 through 8, in the case of the first line data LDATA1 illustrated in FIG. 6, each of a plurality of pixel data blocks included in the first line data LDATA1 includes data representing a color corresponding to "F0". In other words, since the remaining pixel data blocks RPD are all the same as the reference pixel data block NPD, the comparison circuit 552-2 may output an indicator signal IND having a first level (for example, data of 1).

In the case of the second line data LDATA2 illustrated in FIG. 7, the reference pixel data block NPD includes data representing a color corresponding to "F0", but at least one (for example, a second pixel data block from among the remaining pixel data blocks RPD) of the remaining pixel data blocks RPD includes data representing a color corresponding to "A0". In this case, the comparison circuit 552-2 may output an indicator IND having a second level (for example, data of 0).

Figure 9:
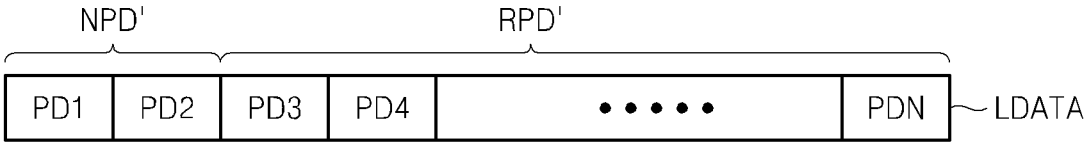
FIG. 9 is a diagram of the reference pixel data block and the rest of the pixel data blocks included in the line data, according to another embodiment of the present inventive concept.

FIG. 9 illustrates a reference pixel data block NPD' and remaining pixel data blocks RPD' included in line data LDATA, according to another exemplary embodiment of the inventive concept. Referring to FIGS. 5 and 9, the reference pixel data block NPD' may include a plurality of sub-pixel data blocks (for example, first and second sub-pixel data blocks PD1 and PD2). The remaining pixel data blocks RPD' may include remaining pixel data blocks PD3 through PDN except for the reference pixel data block NPD' of the line data LDATA.

In this case, the comparison 552-2 may alternately compare the sub-pixel data blocks (for example, the first and second sub-pixel data blocks PD1 and PD2) included in the reference pixel data block NPD' with each of the remaining pixel data blocks PD3 through PDN. For example, the comparison circuit 552-2 may compare the first sub-pixel data block PD1 with a third pixel data block PD3 and may compare the second sub-pixel data block PD2 with a fourth pixel data block PD4. Theses comparisons performed by the comparison circuit 552-2 will now be described in detail with reference to FIGS. 10 through 12.

Figure 10:
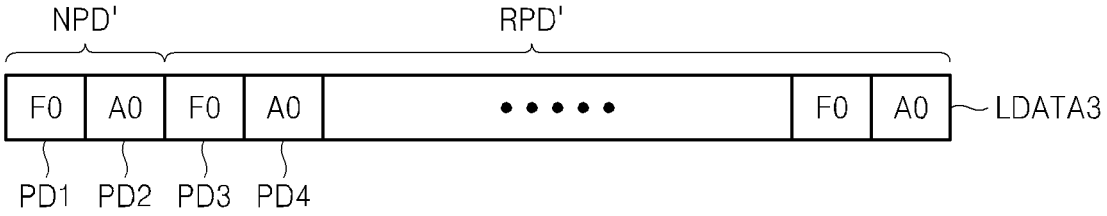
FIG. 10 is a diagram of the line data illustrated in FIG. 9, according to an embodiment of the present inventive concept.
Figure 11:
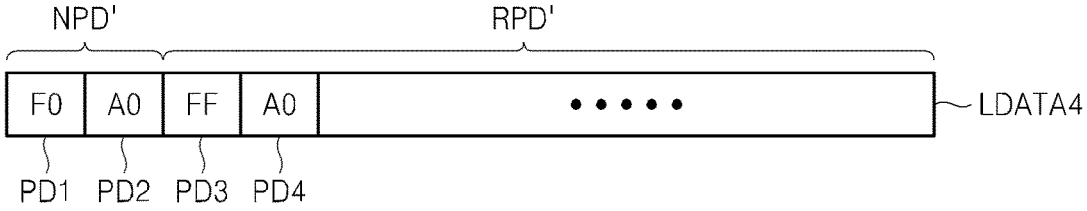
FIG. 11 is a diagram of the line data illustrated in FIG. 9, according to another embodiment of the present inventive concept.

FIG. 10 is a diagram of third line data LDATA3, which is an embodiment of the line data LDATA illustrated in FIG. 9. FIG. 11 is a diagram of fourth line data LDATA4, which is another embodiment of the line data LDATA illustrated in FIG. 9. FIG. 12 is a diagram of indicators IND corresponding to the third and fourth line data LDATA3 and LDATA4 respectively illustrated in FIGS. 10 and 11.

Referring to FIGS. 5, 9, and 10, in the case of the third line data LDATA3 illustrated in FIG. 10, the reference pixel data block NPD' includes the first sub-pixel data block PD1 including data that represents a color corresponding to "F0" and the second sub-pixel data block PD2 including data that represents a color corresponding to "A0".

In this case, the comparison circuit 552-2 may alternately compare the plurality of sub-pixel data blocks (namely, the first sub-pixel data block PD1 and the second sub-pixel data block PD2) included in the reference pixel data block NPD' with each of the remaining pixel data blocks RPD'. For example, the comparison circuit 552-2 may compare the first sub-pixel data block PD1 with the third sub-pixel data block PD3 and may compare the second sub-pixel data block PD2 with the fourth sub-pixel data block PD4.

The first sub-pixel data block PD1 and the third pixel data block PD3 of the third line data LDATA3 each include data representing a color corresponding to "F0", and are the same as each other. The second sub-pixel data block PD2 and the fourth pixel data block PD4 each includes data representing a color corresponding to "A0", and are the same as each other. In other words, since the remaining pixel data blocks RPD' have a pattern in which the reference pixel data block NPD' is repeated, the comparison circuit 552-2 may output an indicator signal IND having a first level (for example, data of 1) according to a result of the comparison.

In the case of the fourth line data LDATA4 illustrated in FIG. 11, since the third pixel data block PD3 includes data representing a color corresponding to "FF" and the first sub-pixel data block PD1 includes data representing a color corresponding to "F0", they are not identical with each other. Thus, the comparison circuit 552-2 may output an indicator signal IND having a second level (for example, data of 0) according to a result of the comparison.

Figure 13:
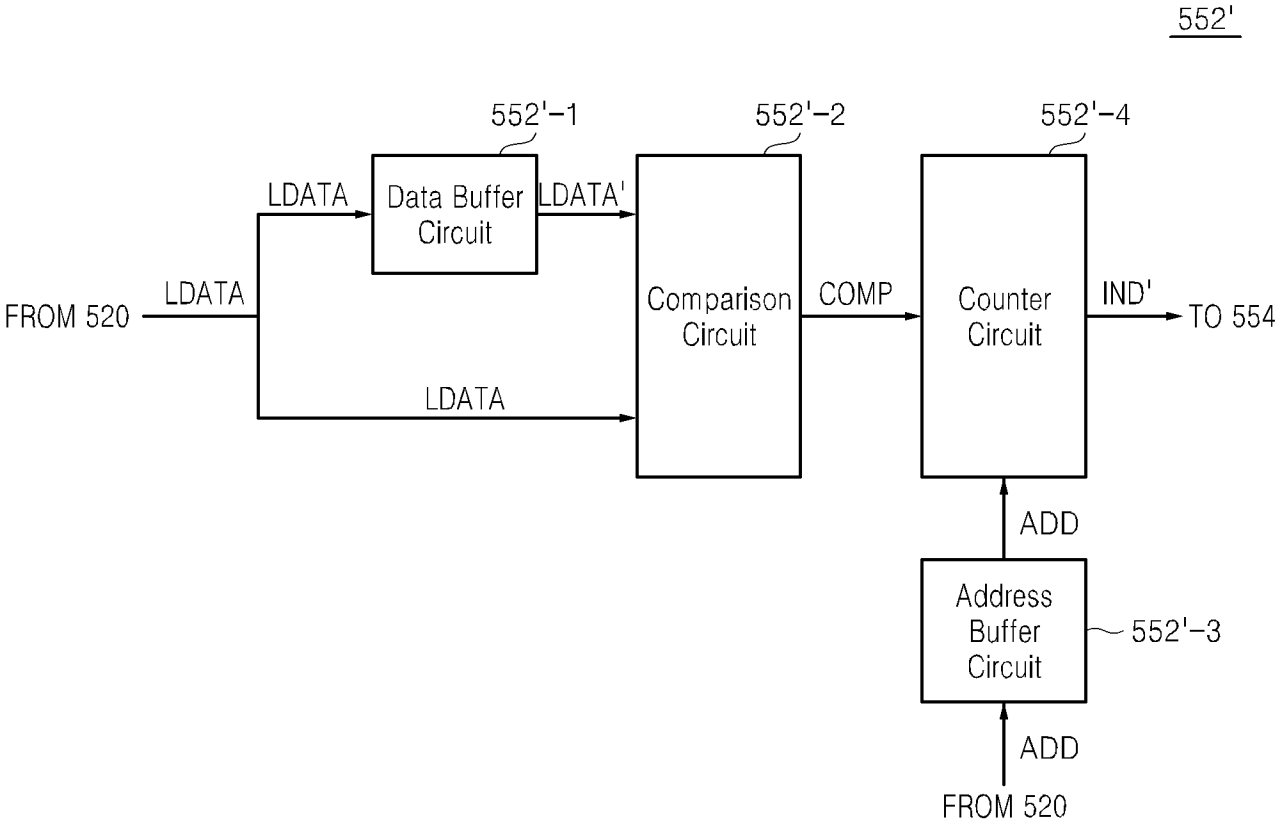
FIG. 13 is a block diagram of the pattern detector illustrated in FIG. 3, according to another embodiment of the present inventive concept.
Figure 14:
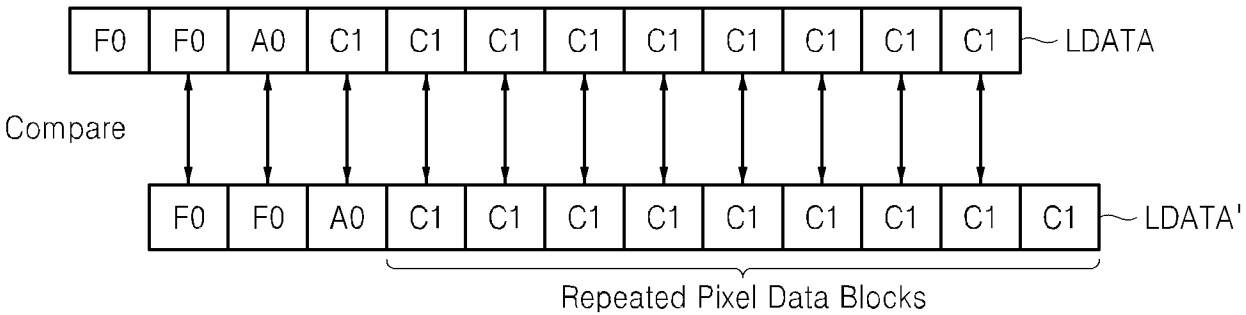
FIG. 14 is a diagram of the line data and the buffered line data illustrated in FIG. 13.

FIG. 13 is a block diagram of a pattern detector 552' included in the indicator generating circuit 550 of FIG. 2, according to another exemplary embodiment of the inventive concept. FIG. 14 illustrates line data LDATA and buffered line data LDATA' illustrated in FIG. 13.

Referring to FIGS. 3 and 13, the pattern detector 552' may include a data buffer circuit 552'-1, a comparison circuit 552'-2, an address buffer circuit 552'-3, and a counter circuit 552'-4.

The data buffer circuit 552'-1 may buffer the line data LDATA and transmit the buffered line data LDATA' to the comparison circuit 552'-2. The data buffer circuit 552'-1 may output the buffered line data LDATA', which is obtained by delaying the line data LDATA by a pixel data block.

For convenience of explanation, FIG. 14 illustrates a case where the line data LDATA includes twelve pixel data blocks, but the technical scope of the inventive concept will not be limited to the number of pixel data blocks.

The comparison circuit 552'-2 may compare the line data LDATA with the buffered line data LDATA' in units of pixel data blocks. A first pixel data block of the buffered line data LDATA' may be compared with a second pixel data block of the line data LDATA. Likewise, a second pixel data block of the buffered line data LDATA' may be compared with a third pixel data block of the line data LDATA. In other words, the comparison circuit 552'-2 may compare adjacent pixel data blocks with each other.

When the adjacent pixel data blocks are identical with each other, the comparison circuit 552'-2 may output a comparison signal COMP having a first level. When the adjacent pixel data blocks are not identical with each other, the comparison circuit 552'-2 may output a comparison signal COMP having a second level. Referring to FIG. 14, the comparison circuit 552'-2 may output the comparison signal COMP having the first level as a result of a comparison corresponding to each of fourth through eleventh pixel data blocks of the buffered line data LDATA'.

The address buffer circuit 552'-3 may receive an address ADD from the graphic memory write controller 520 and store the address ADD. The address buffer circuit 552'-3 may transmit the stored address ADD to the counter circuit 552'-4.

The counter circuit 552'-4 may count comparison signals COMP having a first level (for example, comparison signals COMP output when adjacent pixel data blocks are identical with each other) from among a plurality of comparison signals COMP output by the comparison circuit 552'-2, and may compare a counted value corresponding to a result of the counting with a reference value. According to an exemplary embodiment, the count circuit 552'-4 may generate an indicator signal IND' based on the counted value and the address ADD received from the address buffer circuit 552'-3.

In this case, the indicator signal IND' may include a start address where repetition of identical pixel data blocks starts (for example, an address of a fourth pixel data block of the line data LDATA) and data associated with the number (for example, 9) of repeated pixel data blocks.

Figure 15:
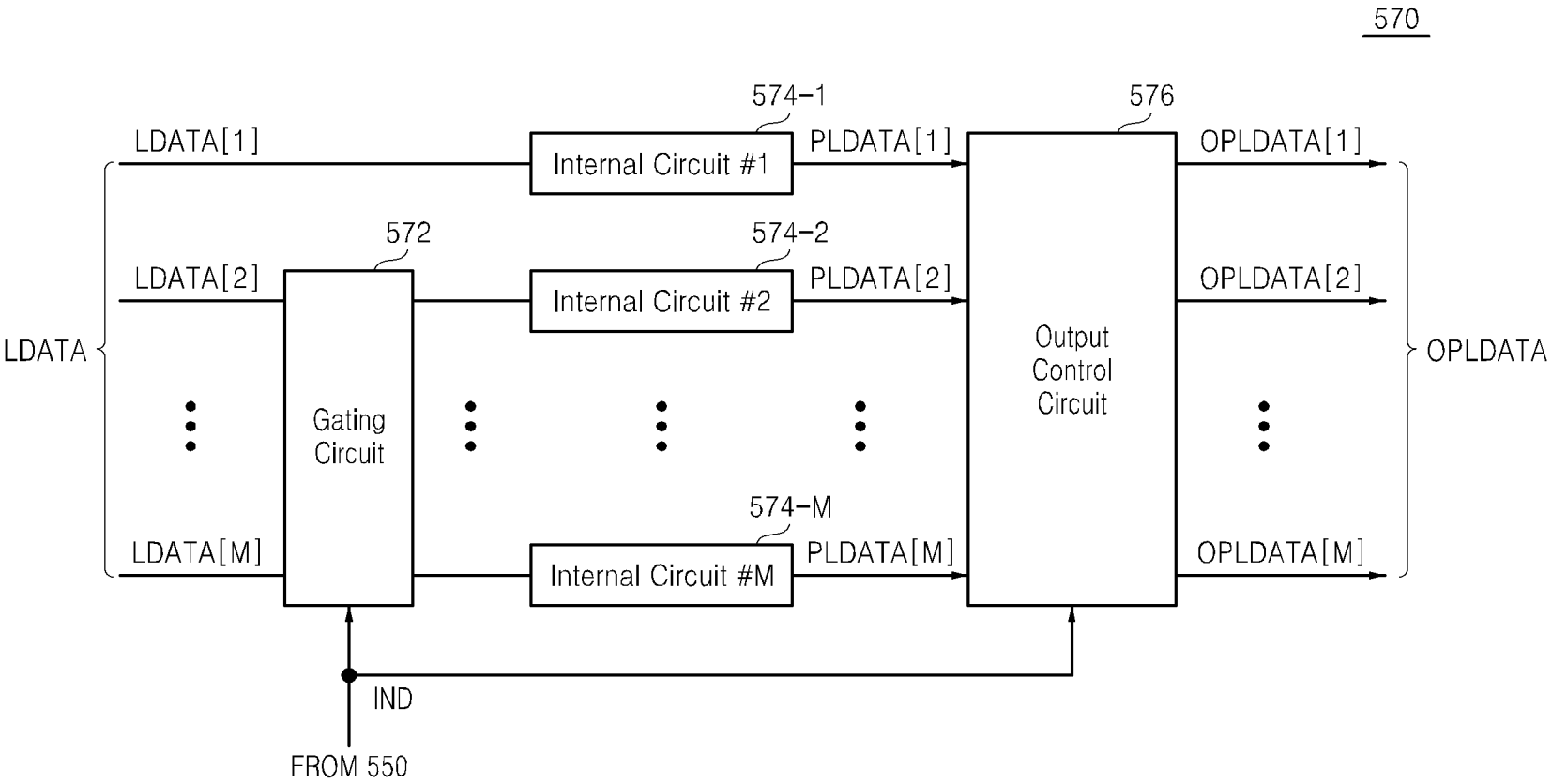
FIG. 15 is a block diagram of an image processing unit illustrated in FIG. 2.

FIG. 15 is a block diagram of the image processing unit 570 illustrated in FIG. 2. Referring to FIGS. 2 and 15, the image processing unit 570 may include a gating circuit 572, a plurality of internal circuits 574-1 through 574-M (where M is a natural number), and an output control circuit 576.

The internal circuits 574-1 through 574-M process line data LDATA read from the graphic memory read controller 560, in parallel. The gating circuit 572 may gate (namely, turn on or off) line data (for example, line data LDATA[2] through LDATA[M]) corresponding to repeated pixel data blocks of the line data LDATA, based on the indicators IND. In other words, the gating circuit 572 may deactivate a part (for example, the internal circuits 574-2 through 574-M) of the image processing unit 570, based on the indicator signals IND. Thus, the gating circuit 572 may contribute to a decrease in power consumption of the image processing unit 570.

According to an exemplary embodiment, FIG. 15 illustrates a case where the line data LDATA is divided into the line data LDATA[1] through LDATA[M] to process the line data LDATA in parallel. However, the line data LDATA may be divided in units of pixel data blocks, and the inventive concept is not limited thereto.

The output control circuit 576 may receive processed line data PLDATA[1] through PLDATA[M] from the internal circuits 574-1 through 574-M, respectively, may select output paths of the processed line data PLDATA[1] through PLDATA[M] based on the indicators IND, and may output line data OPLDATA[1] through OPLDATA[M] according to results of the selections. A structure and an operation of the output control circuit 576 will be now described in detail with reference to FIG. 16.

Figure 16:
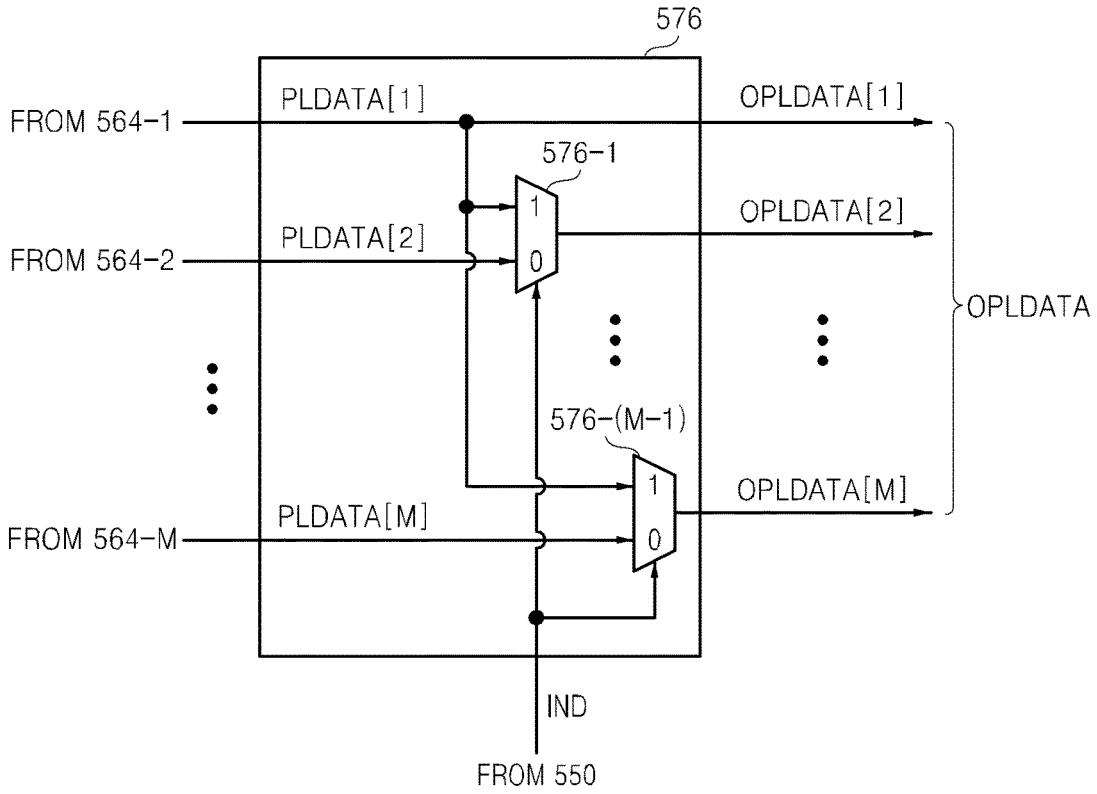
FIG. 16 is a circuit diagram of an output control circuit illustrated in FIG. 15.

FIG. 16 is a circuit diagram of the output control circuit 576 illustrated in FIG. 15. Referring to FIGS. 15 and 16, the output control circuit 576 may include a plurality of selectors 576-1 through 576-(M−1).

Each of the selectors 576-1 through 576-(M−1) may select an output path based on the indicator signals IND received from the indicator generating circuit 550. According to an embodiment, when an indicator signal IND having a first level (for example, "1") is input as a selection signal to each of the selectors 576-1 through 576-(M−1), the processed line data PLDATA[1], namely, a first processed line data PLDATA[1], may be output as the line data OPLDATA[2] through OPLDATA[M] corresponding to the processed line data PLDATA[2] through PLDATA[M], namely, remaining processed line data PLDATA[2] through PLDATA[M].

According to another exemplary embodiment, when an indicator IND having a second level (for example, "0") is input as a selection signal to each of the selectors 576-1 through 576-(M−1), the remaining processed line data PLDATA[2] through PLDATA[M] may be selected and output as the line data OPLDATA[2] through OPLDATA [M], respectively.

Figure 17:
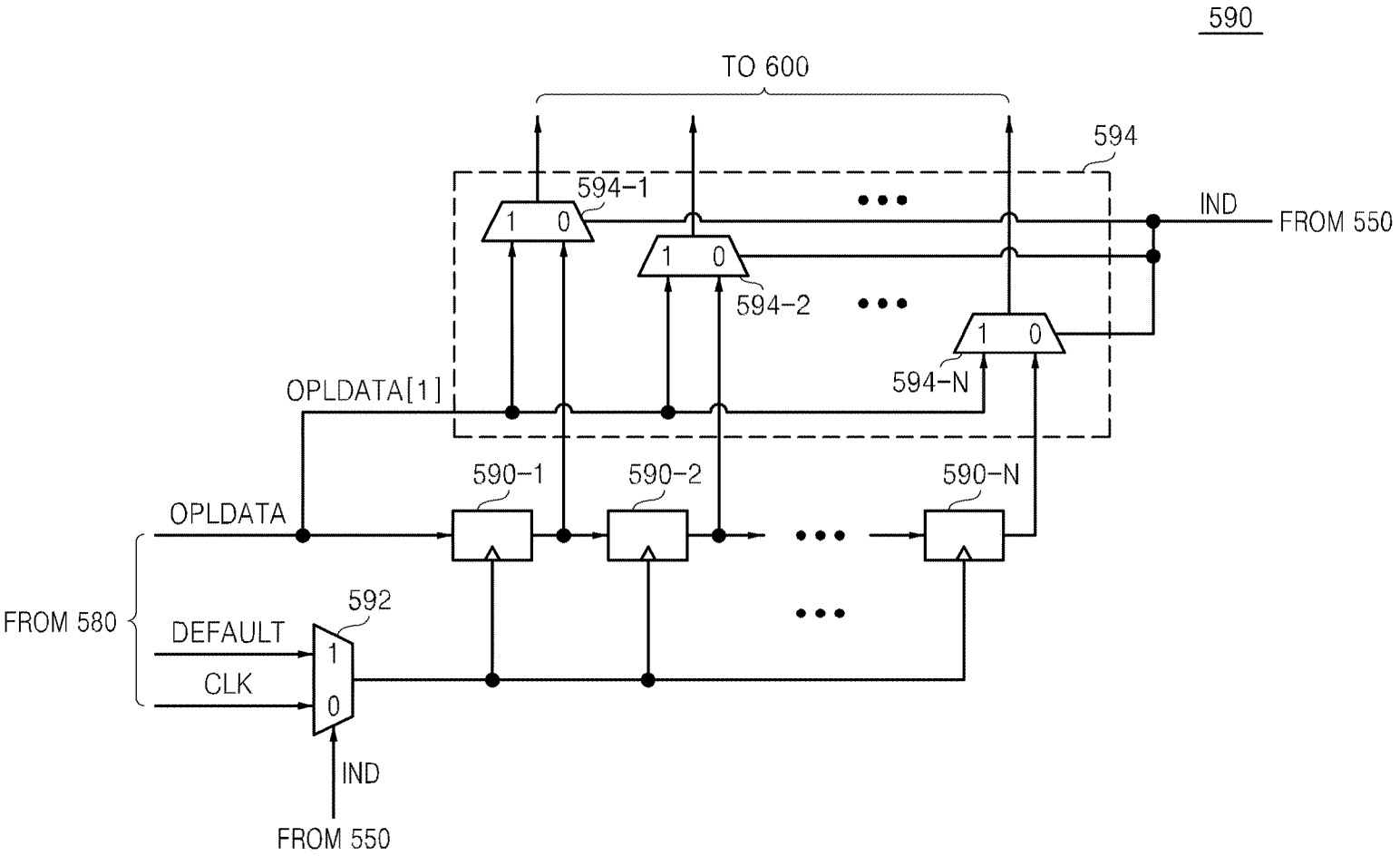
FIG. 17 is a circuit diagram of a shift register illustrated in FIG. 2.

FIG. 17 is a circuit diagram of the data shift register 590 illustrated in FIG. 2. Referring to FIGS. 2 and 17, the data shift register 590 may include a plurality of latches 590-1 through 590-N, a clock selecting circuit 592, and an output selecting circuit 594.

The latches 590-1 through 590-N may perform data shifting operations with respect to output line data OPLDATA received from the source shift register controller 580. The latches 590-1 through 590-N may perform the data shifting operations in response to a clock signal CLK or a default signal DEFAULT received from the source shift register controller 580.

The clock selection circuit 592 may select the clock signal CLK or the default signal DEFAULT received from the source shift register controller 580, based on an indicator signal IND received as a selection signal. The clock selection circuit 592 may select the default signal DEFAULT when an indicator signal IND having a first level (for example, "1") is received, and may select the clock signal CLK when an indicator signal IND having a second level (for example, "0") is received.

The default signal DEFAULT may denote a signal capable of interrupting the data shifting operations of the latches 590-1 through 590-N, in a broad sense.

According to an exemplary embodiment, the clock selection circuit 592 may be included in the source shift register controller 580. In this case, the source shift register controller 580 may directly transmit the clock signal CLK or the default signal DEFAULT to each of the latches 590-1 through 590-N, based on the indicator signal IND. For example, the source shift register controller 580 may directly transmit the default signal DEFAULT to each of the latches 590-1 through 590-N, based on the indicator IND having the first level (for example, "1"), and may transmit the clock signal CLK to each of the latches 590-1 through 590-N, based on the indicator signal IND having the second level (for example, "0")

The output selection circuit 594 may include a plurality of selectors 594-1 through 594-N. Each of the selectors 594-1 through 594-N may select an output based on the indicator signal IND received from the indicator generating circuit 550.

According to an exemplary embodiment, when the indicator signal IND having the first level is input as a selection signal to each of the selectors 594-1 through 594-N, the first output line data OPLDATA[1] may be processed in parallel and selected as outputs corresponding to the remaining output line data OPLDATA[2] through OPLDATA[N]. According to another exemplary embodiment, when the indicator signal IND having the second level input as a selection signal to each of the selectors 594-1 through 594-N, output line data OPLDATA corresponding to results of the data shifting operations may be selected and output. In other words, respective outputs of the latches 590-1 through 590-N may be selected and transmitted to the data latch 600.

Figure 18:
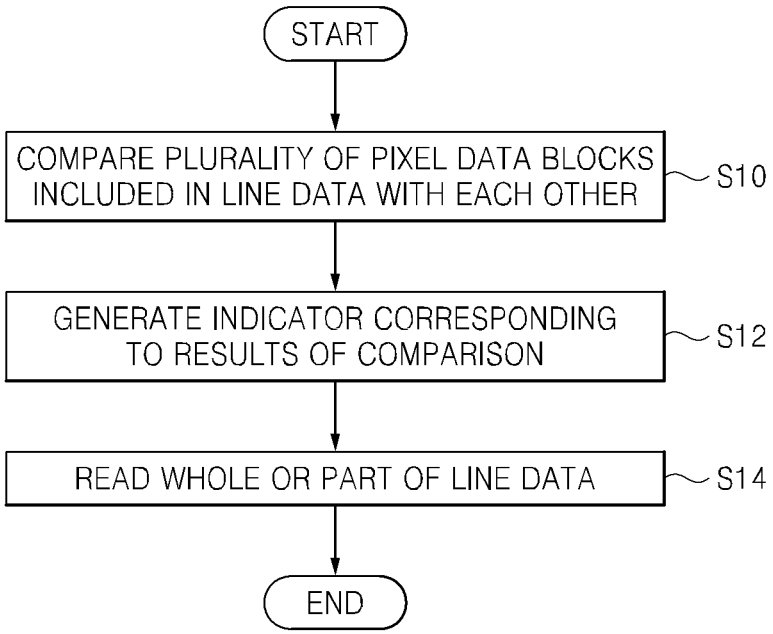
FIG. 18 is a flowchart of a method of operating the DDI according to an embodiment of the present inventive concept.

FIG. 18 is a flowchart of a method of operating the DDI 500, according to an exemplary embodiment of the inventive concept. Referring to FIGS. 2 through 18, the indicator generating circuit 550 may compare the pixel data blocks PD1 through PDN included in the line data LDATA with each other, in operation S10.

According to an exemplary embodiment, the indicator generating circuit 550 may compare the reference pixel data block NPD from among the pixel data blocks PD1 through PDN with each of the remaining pixel data blocks RPD.

The indicator generating circuit 550 may generate the indicator signals IND corresponding to results of the comparisons, in operation S12. The indicator generating circuit 550 may transmit the generated indicator signals IND to each of the graphic memory read controller 560, the image processing unit 570, the source shift register controller 580, and the data shift register 590.

The graphic memory read controller 560 may read the whole or a part of the line data LDATA based on the read command RCMD and the indicator signals IND for the line data LDATA, in operation S14.

Figure 19:
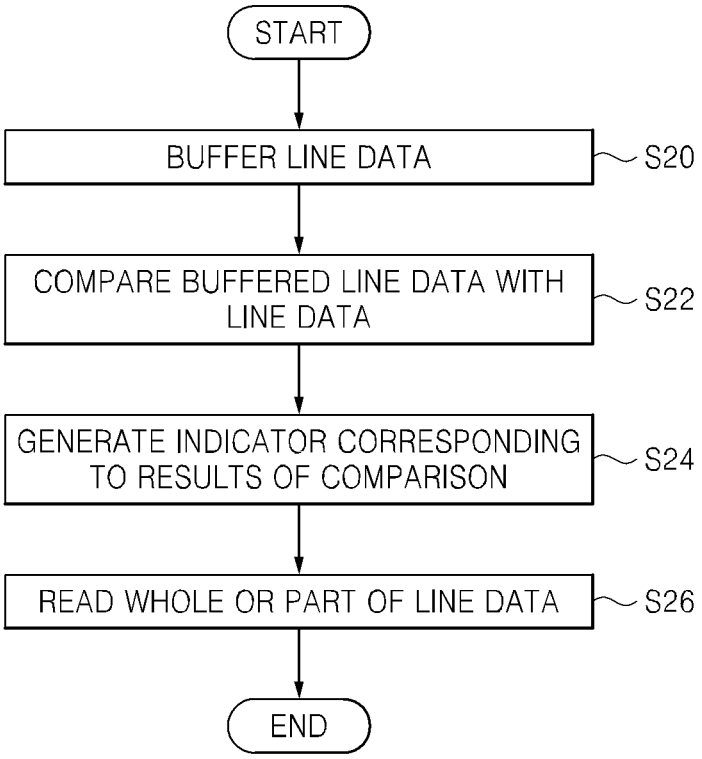
FIG. 19 is a flowchart of a method of operating the DDI according to another embodiment of the present inventive concept.

FIG. 19 is a flowchart of a method of operating the DDI 500, according to another exemplary embodiment of the inventive concept. Referring to FIGS. 2, 3, 13, 14, and 19, the data buffer circuit 552'-1 may buffer the line data LDATA and may output the buffered line data LDATA', in operation S20.

According to an exemplary embodiment, the data buffer circuit 552'-1 may output the buffered line data LDATA', which is obtained by delaying the line data LDATA by a pixel data block.

The comparison circuit 552'-2 may compare the line data LDATA with the buffered line data LDATA' in units of pixel data blocks, in operation S22. The counter circuit 552'-4 may generate the indicator signal IND' corresponding to the results of the comparisons of the comparison circuit 552'-2, in operation 24.

According to an exemplary embodiment, the counter circuit 552'-4 may count the comparison signals COMP output when adjacent pixel data blocks are identical with each other from among the comparison signals COMP output by the comparison circuit 552'-2, and may compare the counted value corresponding to a result of the counting with the reference value. In this case, the counter circuit 552'-4 may generate the indicator signal IND' based on the counted value and the address ADD received from the address buffer circuit 552'-3. The graphic memory read controller 560 may read the whole or a part of the line data LDATA, based on the read command RCMD and the indicator signal IND' for the line data LDATA, in operation 26.

Figure 20:
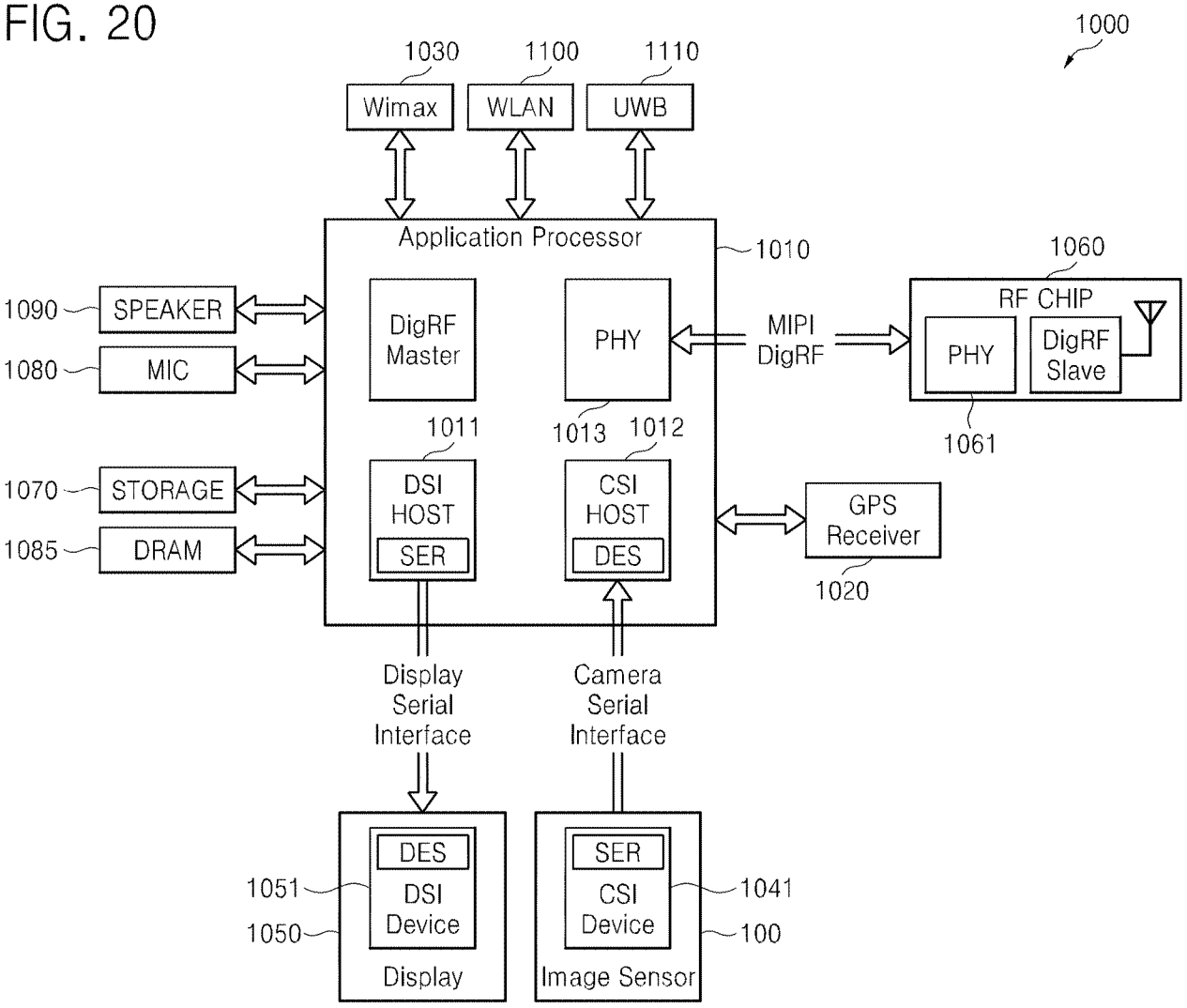
FIG. 20 is a block diagram of an electronic system according to an embodiment of the present inventive concept.

FIG. 20 is a block diagram of an electronic system 1000 according to an exemplary embodiment of the inventive concept. Referring to FIGS. 1 and 20, the electronic system 1000 may be implemented by using a data processing device capable of using or supporting an MIPI interface, for example, a PDA, a PMP, an Internet Protocol television (IPTV), a smartphone, a tablet PC, an MID, an internet tablet, or a wearable computer. An AP 1010 may be implemented by using the AP 400 of FIG. 1.

A camera serial interface (CSI) host 1012 implemented in the AP 1010 may serially communicate with a CSI device 1041 of an image sensor 100 via a CSI. In this case, the CSI host 1012 may include a de-serializer (DES), and the CSI device 1041 may include a serializer (SER).

A display serial interface (DSI) host 1011 implemented in the AP 1010 may serially communicate with a DSI device 1051 of a display 1050 via the DSI. In this case, the DSI host 1011 may include an SER, and the DSI device 1051 may include a DES. The display 1050 may be implemented by including the DDI 500 and the display panel 700 of the FIG. 1.

According to an exemplary embodiment, the electronic system 1000 may further include a radio frequency (RF) chip 1060 capable of communicating with the AP 1010. A PHYsical layer (PHY) 1013 included in the AP 1010 and a PHY 1061 included in the RF chip 1060 may exchange data with each other according to a MIPI DigRF.

According to an exemplary embodiment, the electronic system 1000 may further include a global positioning system (GPS) receiver 1020, a storage 1070, a microphone (MIC) 1080, a dynamic random access memory (DRAM) 1085, and a speaker 1090. The electronic system 1000 may communicate with an external apparatus by using a world interoperability for microwave access (Wimax) module 1030, a wireless local area network (WLAN) module 1100, and/or an ultra wideband (UWB) module 1110.

In methods and devices according to exemplary embodiments of the inventive concept, when pixel data blocks included in line data are repeated, power consumption may be decreased by performing a read operation on a part of the line data. Also, when the pixel data blocks of the line data are repeated, power consumption may be decreased by deactivating a part of an image processing unit or controlling a data shifting operation of a data shift register.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A display driver integrated circuit (DDI) comprising:

a graphic memory configured to receive and store display data, the display data comprising a plurality of line data, each of the plurality of line data corresponding to a line of a display, the plurality of line data including first line data including a plurality of pixel data blocks, the plurality of pixel data blocks of the first line data comprising a reference pixel data block and a plurality of remaining pixel data blocks comprising the plurality of pixel data blocks except for the reference pixel data block;

an indicator generating circuit configured to compare the reference pixel data block of the first line data with each of the plurality of remaining pixel data blocks of the first line data and to generate an indicator signal corresponding to results of the comparisons;

a read controller configured to read only part of the first line data from the graphic memory, based on a read command received from a timing controller for the first line data and the indicator signal;

a write controller configured to receive the first line data from an interface of the DDI, to control writing of the received first line data to the graphic memory, and to transmit the received first line data to the indicator generating circuit for the comparisons; and an image processing unit configured to process all or the part of the first line data read by the read controller, wherein the image processing unit comprises a gating circuit to deactivate a part of the image processing unit in response to the indicator signal.

2. The DDI of claim 1, wherein the reference pixel data block is a first pixel data block from among the plurality of pixel data blocks.

3. The DDI of claim 1, wherein the indicator generating circuit comprises:

a buffer circuit configured to receive and store the reference pixel data block; and a comparison circuit configured to compare the reference pixel data block with each of the remaining pixel data blocks.

4. The DDI of claim 3, further comprising a counter circuit configured to generate the indicator signal at a first level in response to the comparison circuit indicating each of the remaining pixel data blocks being the same as the reference pixel data block, and configured to generate the indicator signal at a second level in response to the comparison circuit indicating at least one of the remaining pixel data blocks not being the same as the reference pixel data block.

5. The DDI of claim 1, wherein the reference pixel data block comprises a plurality of sub-pixel data blocks.

6. The DDI of claim 5, wherein the indicator generating circuit comprises a comparison circuit configured to compare a first group of the plurality of sub-pixel data blocks included in the reference pixel data block with each of a plurality of groups of the remaining pixel data blocks.

7. The DDI of claim 1, further comprising: a source shift register controller configured to control whether a data shifting operation of a data shift register is performed, in response to the indicator signal.

8. The DDI of claim 7, wherein, the source shift register controller is configured to control the data shift register not to perform the data shifting operation in response to each of the remaining pixel data blocks being the same as the reference pixel data block, and the source shift register controller is configured to control the data shift register to perform the data shifting operation in response to at least one of the remaining pixel data blocks being different from the reference pixel data block.

9. The DDI of claim 1, wherein the indicator generating circuit is configured to compare the plurality of remaining pixel data blocks with the reference pixel data block while the first line data is being transmitted to and stored in the graphic memory.

10. The display driver integrated circuit of claim 1, further comprising a source driver configured to transmit stored line data to a display panel to control operations of pixels of the display panel, wherein each of the pixel data blocks are data corresponding to a color displayed by a unit pixel of the display panel that is a combination of pixels displaying different colors.

11. A display device comprising:

a display driver integrated circuit (DDI); and a display panel that is driven by the DDI, wherein the DDI comprises:

a graphic memory configured to receive and store display data, the display data comprising a plurality of line data, including first line data including a plurality of pixel data blocks, the plurality of pixel data blocks of the first line data comprising a reference pixel data block and a plurality of remaining pixel data blocks comprising the plurality of pixel data blocks except for the reference pixel data block, each of the plurality of line data corresponding to a line of a display;

an indicator generating circuit configured to compare the reference pixel data block of the first line data with each of the plurality of remaining pixel data blocks of the first line data, and to generate an indicator signal corresponding to results of the comparisons;

a read controller configured to perform a read operation with respect to only a part of the first line data from the graphic memory, based on a read command received from a timing controller for the first line data and the indicator signal;

a write controller configured to receive the first line data from an interface of the DDI, to control writing of the received first line data to the graphic memory, and to transmit the received first line data to the indicator generating circuit for the comparisons; and an image processing unit configured to process all or the part of the first line data read by the read controller, wherein the image processing unit comprises a gating circuit to deactivate a part of the image processing unit in response to the indicator signal.

12. The display device of claim 11, wherein the indicator generating circuit comprises:

a buffer circuit configured to receive and buffer the reference pixel data block; and a comparison circuit configured to compare the buffered reference pixel data block with each of the remaining pixel data blocks.

13. The display device of claim 11, wherein the DDI further comprises a source driver configured to transmit stored line data to the display panel to control operations of pixels of the display panel, wherein each of the pixel data blocks are data corresponding to a color displayed by a unit pixel of the display panel that is a combination of pixels displaying different colors.

14. A display system comprising:

a display driver integrated circuit (DDI);

an application processor (AP) configured to output display data to the DDI, the display data comprising a plurality of line data, including first line data including a plurality of pixel data blocks, the plurality of pixel data blocks of the first line data comprising a reference pixel data block and a plurality of remaining pixel data blocks comprising the plurality of pixel data blocks except for the reference pixel data block; and a display panel that is driven by the DDI, wherein the DDI comprises:

a graphic memory configured to receive and store the first line data;

an indicator generating circuit configured to compare the reference pixel data block of the first line data with each of the plurality of remaining pixel data blocks of the first line data, and to generate an indicator signal corresponding to results of the comparisons;

a read controller configured to perform a read operation with respect to only a part of the first line data from the graphic memory, based on a read command received from a timing controller for the first line data and the indicator signal;

a write controller configured to receive the first line data from an interface of the DDI, to control writing of the received first line data to the graphic memory, and to transmit the received first line data to the indicator generating circuit for the comparisons; and an image processing unit configured to process all or the part of the first line data read by the read controller, wherein the image processing unit comprises a gating circuit to deactivate a part of the image processing unit in response to the indicator signal.

15. The display system of claim 14, wherein the indicator generating circuit comprises:

a buffer circuit configured to receive and store the reference pixel data block; and a comparison circuit configured to compare the stored reference pixel data block with each of the remaining pixel data blocks.

16. The display system of claim 14, wherein the DDI further comprises a source driver configured to transmit stored line data to the display panel to control operations of pixels of the display panel, wherein each of the pixel data blocks are data corresponding to a color displayed by a unit pixel of the display panel that is a combination of pixels displaying different colors.

* * * * *